United States Patent [19]

Kerzee et al.

[11] 3,957,115

[45] May 18, 1976

[54] METHOD AND APPARATUS FOR TREATING WELLS

[75] Inventors: Richard Kerzee, Longview; Robert W. McCollum, Allen; Carter R. Young, Lewisville, all of Tex.

[73] Assignee: Otis Engineering Corporation, Dallas, Tex.

[22] Filed: Apr. 15, 1974

[21] Appl. No.: 460,773

[52] U.S. Cl. ..... 166/297; 166/305 R; 166/315

[51] Int. Cl.[2] ..... E21B 29/00; E21B 23/00

[58] Field of Search ..... 166/297, 284, 305, 307, 166/308, 315

[56] References Cited

UNITED STATES PATENTS

| | | | |
|---|---|---|---|
| 2,839,142 | 6/1958 | Huber | 166/297 |
| 3,111,988 | 11/1963 | Davis et al. | 166/297 |
| 3,130,784 | 4/1964 | Pennington | 166/297 X |
| 3,527,302 | 9/1970 | Broussard | 166/297 |
| 3,706,344 | 12/1972 | Vann | 166/297 |
| 3,820,604 | 6/1974 | Karnes | 166/297 |

*Primary Examiner*—James A. Leppink
*Attorney, Agent, or Firm*—H. Mathews Garland

[57] ABSTRACT

A method of incrementally treating a section of an earth formation around a well to improve fluid flow into the well. The method includes the steps of installing a well casing provided with spaced landing nipples, perforating and treating a bottom portion of the formation by suitable standard procedures including employing a packer in the casing above the location of perforation and treating, running a retrievable plug into the well bore, releasably locking the plug at one of the landing nipples above the first location of perforation and treating, running a perforator into the well above the plug and perforating the casing above the plug, treating the formation through the perforations above the plug, and thereafter sequentially treating the formation at selected depths up the hole by engaging the plug with a combination overshot handling tool and perforator to lift the plug upwardly and install the plug at the next landing nipple above the previously perforated and treated zone.

6 Claims, 17 Drawing Figures

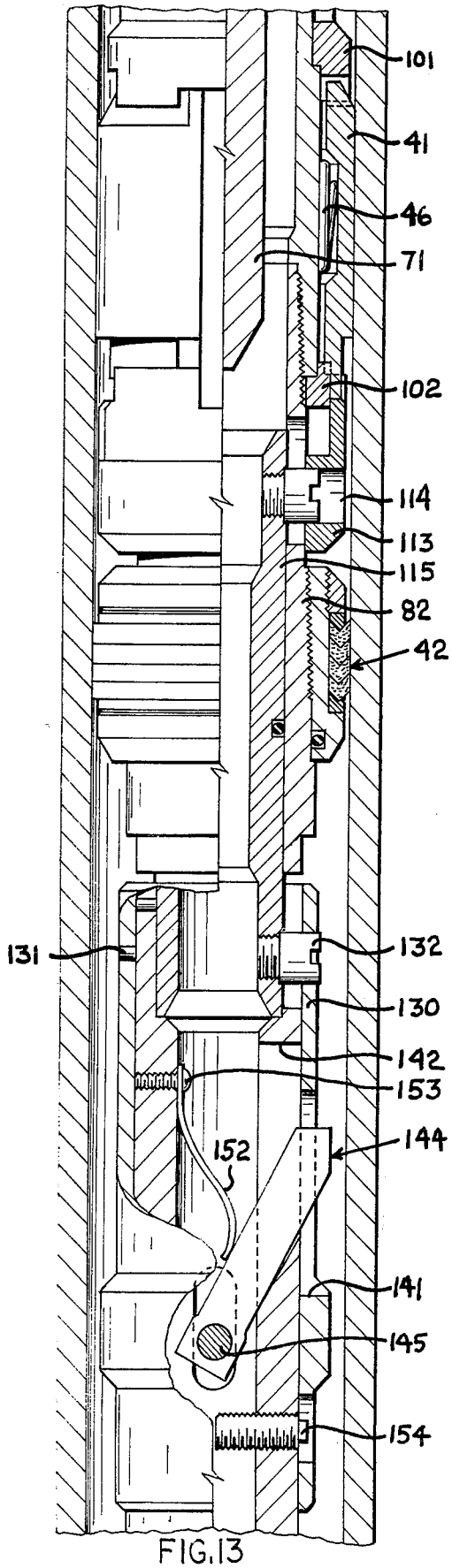
FIG. 13
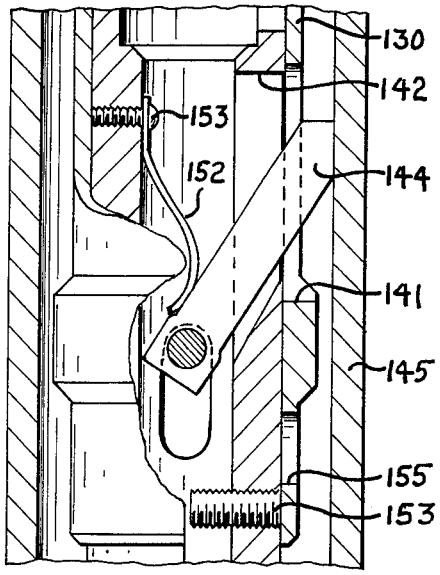
FIG. 10
FIG. 11
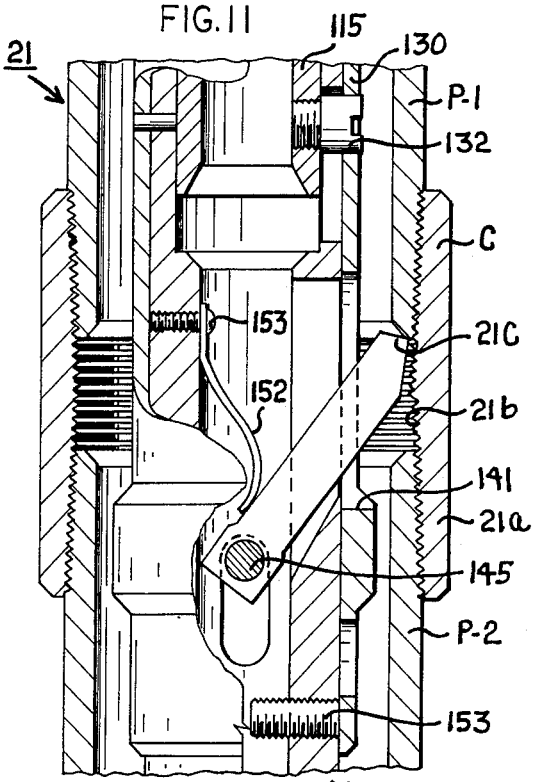
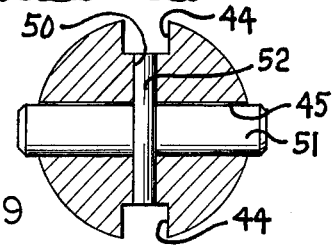
FIG. 9

METHOD AND APPARATUS FOR TREATING WELLS

This invention relates to well treating methods and apparatus and more specifically relates to a method and apparatus for forcing fluids into earth formations surrounding well bores.

It has been common practice in the oil and gas industry to treat earth formations for improving the flow of petroleum oil and gas into well bores drilled into the formations. Among a number of well treating methods are fracturing and acidizing. Fracturing invloves the high pressure injection of liquids which break up a formation to the extent that new fluid flow passages are formed and existing passages are widened to improve fluid flow through the formation. In acidizing a well, various chemicals are introduced into a formation for such purposes as increasing the permeability of the formation which allows more flow of well fluids into the well bore. Particular problems are encountered in the treatment of especially thick formations which may extend several hundred feet or more along a well bore. In such formations it is often difficult to control the flow of treating fluids through perforations in the well casing in such a manner that thorough even treatment of all of the formation is effected. It is desirable to treat such formations in sufficiently small increments that treatment of all portions of the entire formation is achieved. While the incremental treatment of a formation is not basically new, there are problems with the existing techniques and equipment which require excessive tool manipulation and trips into a well in order to fully treat an entire formation.

A principal object of this invention is to provide a new and improved method and apparatus for the treatment of wells.

It is another object of the invention to provide new and improved apparatus for injecting well treating fluids into formations surrounding well bores.

It is still another object of the invention to provide new and improved well treating methods and apparatus for incrementally treating thick formations penetrated by well bores.

It is another object of the invention to provide a retrievable plug for use in a well bore to temporarily plug the bore for carrying out well treating operations.

In accordance with a preferred form of the invention, a well treating method is provided including the steps of perforating the well casing at a first depth and treating a portion of the well formation through such first perforations, installing a retrievable plug at a landing nipple above the first perforations, providing second perforations in the well casing above the plug, treating the well formation through the second perforations, engaging and lifting the plug to a landing nipple above the second perforations, perforating the well casing above the plug, again treating the well formation through the perforations above the plug, and thereafter sequentially resetting the plug at a lesser depth, perforating the well casing above the plug, and treating the well formation through the perforations above the plug, until the entire depth of the formation has been sequentially treated progressively moving up the well bore in relatively small increments. The apparatus used in carrying out the invention incudes a retrievable plug which is initially run into the well to the landing nipple above the lowest perforations, activated to release locking keys on the mandrel of the plug, and thereafter is raised and reset sequentially up the well at progressively shallower landing nipples by simply engaging the head of the plug and lifting the plug upwardly to each of the succeeding landing nipples. The plug includes a body mandrel, a pair of keys which are biased radially outwardly on the mandrel, an operator finger which is engageable with a coupling recess to activate the tool by holding it against movement to release locking keys, an annular key keeper slidably supported on the mandrel for retaining the keys inwardly until the keeper is moved responsive to engagement of the operator finger at a coupling recess, and a handling head including a valve member which is lifted to allow fluid bypass flow through the tool as it is raised and lowered in the well bore, the valve moving downwardly to a closed position when the plug is set at a landing nipple for shutting off flow through the body mandrel of the tool to close the well for carrying out a treating process, and seal assembly around the body mandrel for sealing between the body mandrel and the casing bore wall below the keys.

The details of the preferred embodiments of the invention will be better understood from the following description taken in conjunction with the accompanying drawings wherein.

Figure 8:
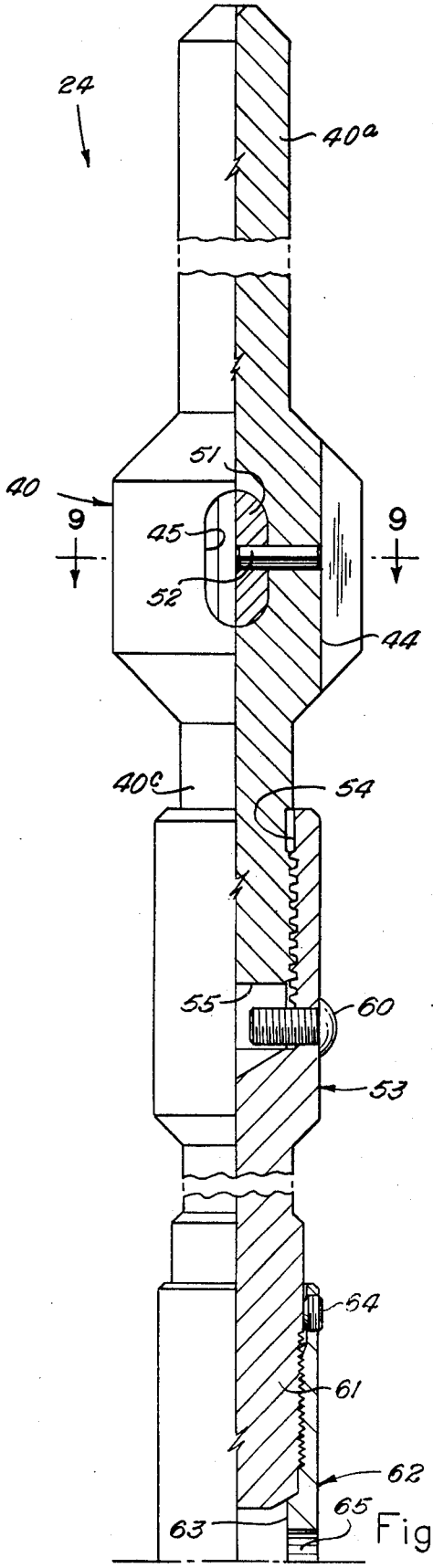
Figure 8A:
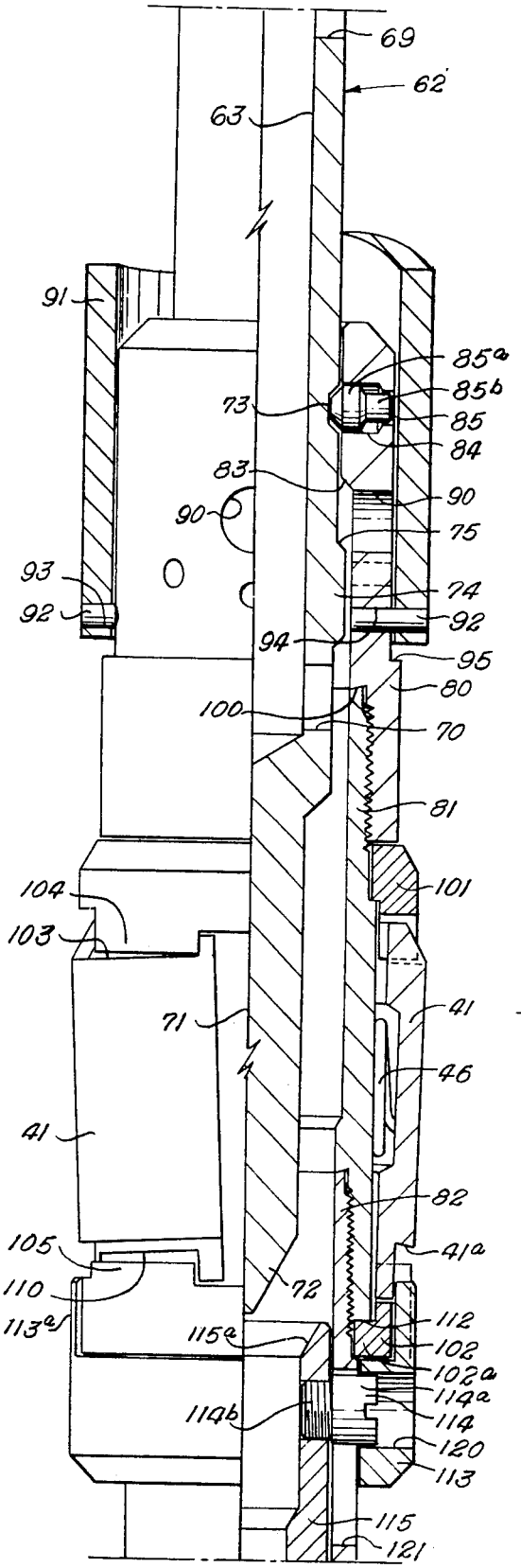
Figure 8B:
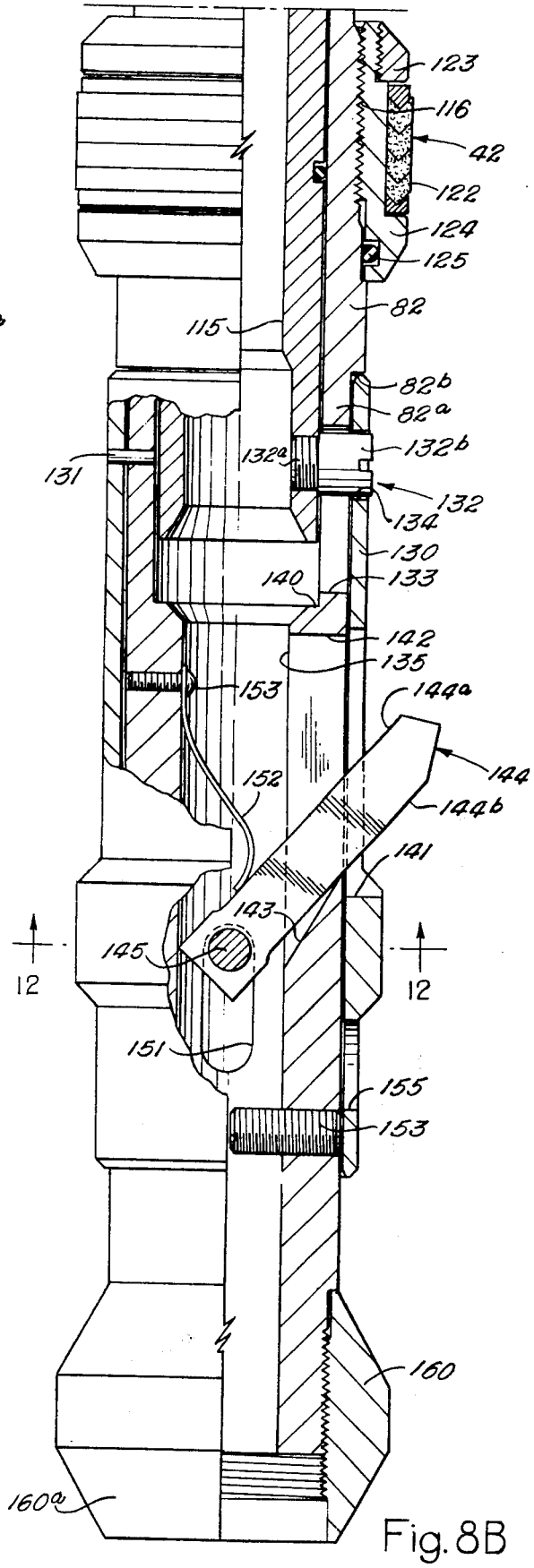
Figure 15:
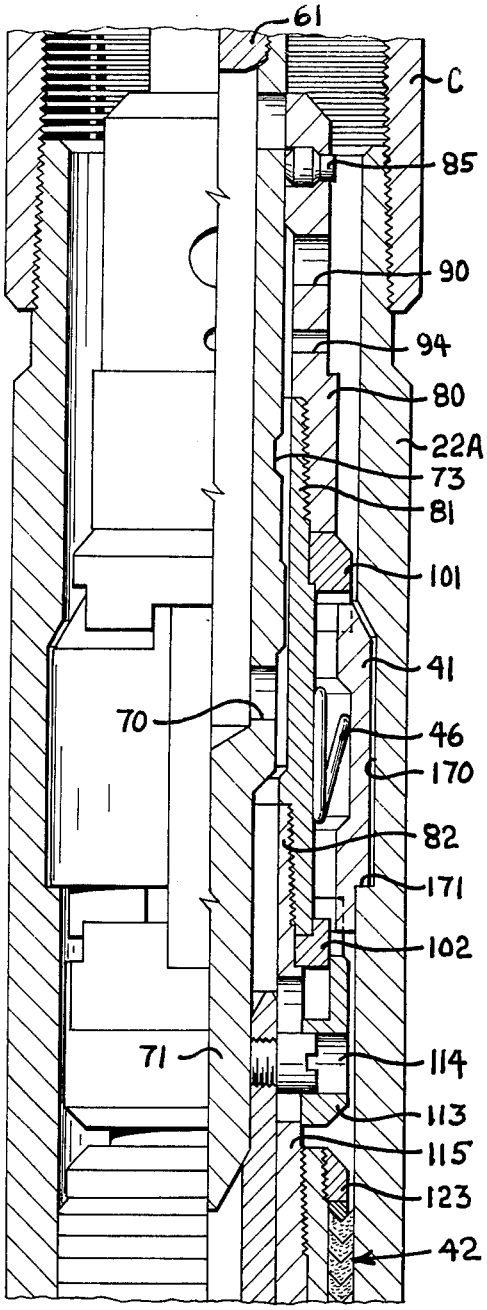
Figure 12:
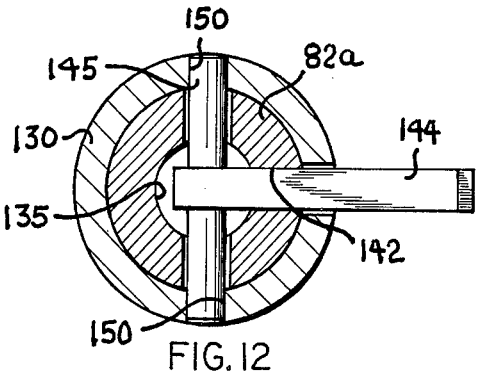
Figure 14:
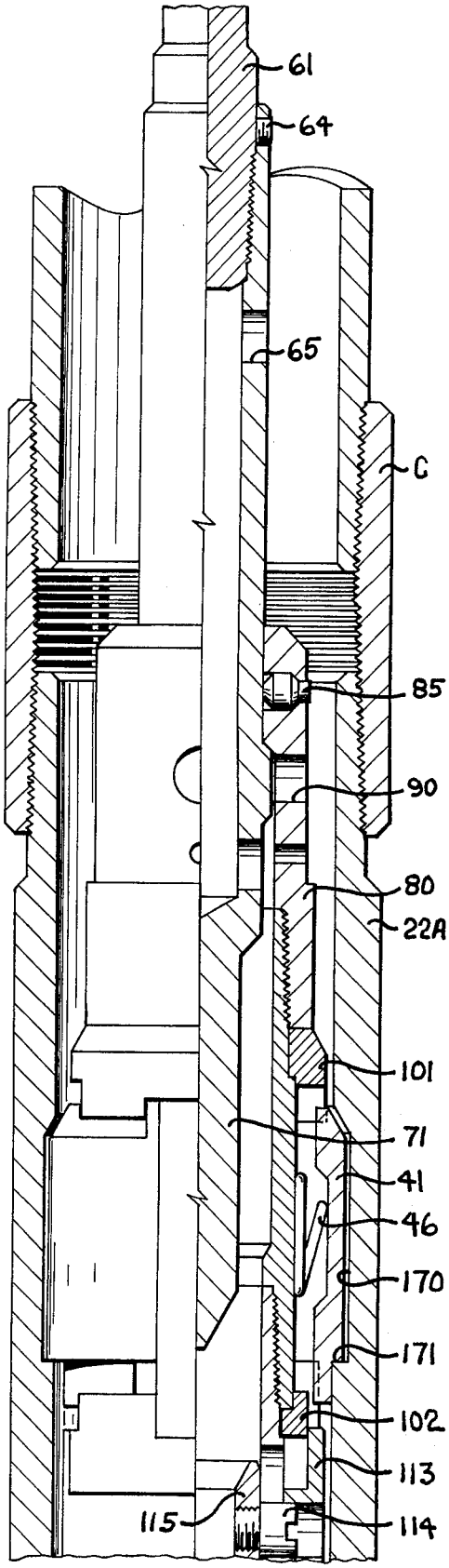

FIGS. 8, 8A, and 8B taken together comprise an enlarged view in section and elevation showing the retrievable plug prior to insertion into the well casing;

FIG. 9 is a view in section and elevation along the line 9—9 of FIG. 8, rotated 90 degrees;

FIG. 10 is a fragmentary view in section of a portion of the well plug showing the position of the operator finger as the plug is lowered in the well casing;

FIG. 11 is a fragmentary view in section and elevation similar to FIG. 10 showing the operator finger of the plug at a coupling recess for activating the locating and locking keys of the plug;

FIG. 12 is a view in section and elevation along the line 12—12 of FIG. 8B;

FIG. 13 is a fragmentary view in section and elevation of the plug showing the released locking keys dragging along the bore wall of the casing and the partially retracted operator finger after engagement with a coupling recess as in FIG. 11;

FIG. 14 is a fragmentary view in section and elevation showing the locating and locking keys of the plug expanded into the locking recess of a landing nipple in the well casing and the valve of the plug open for fluid bypass; and FIG. 15 is a fragmentary view in section and elevation of a portion of the well plug showing the valve of the plug closed as during a well treating step above the plug.

Figure 1:
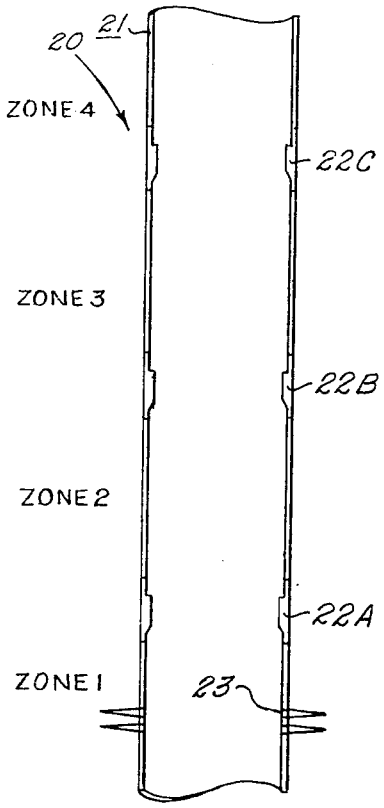
FIG. 1 is a schematic fragmentary view in section of a well casing including spaced landing nipples and a first set of casing perforations used in carrying out the first step of the method of the invention.
Figure 2:
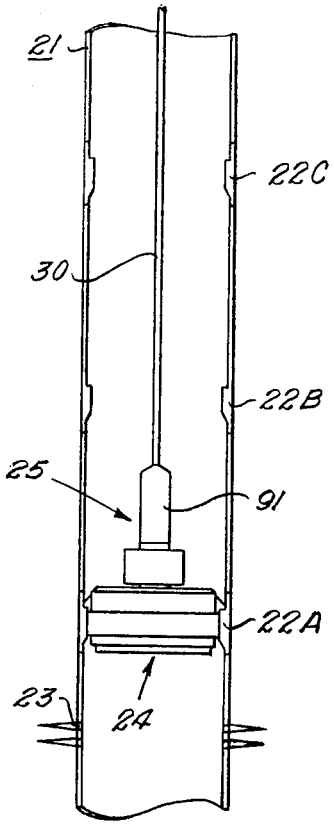
FIG. 2 is a fragmentary schematic view of the cased well shown in FIG. 1 illustrating the step in installing the retrievable plug at the landing nipple above the first lower perforations.
Figure 3:
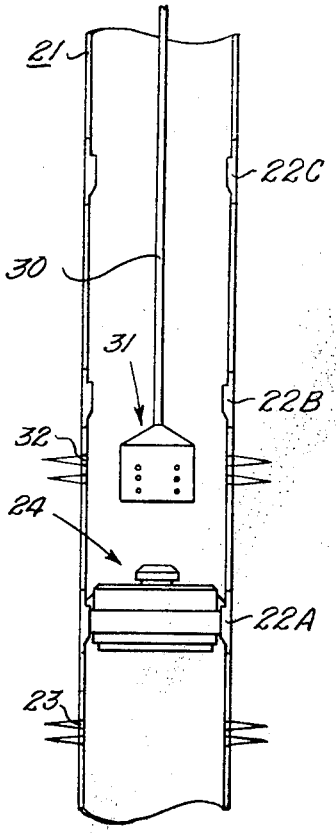
FIG. 3 is a fragmentary schematic view of the well showing a step of perforating the casing at a second level above the plug.

Referring to FIG. 1 of the drawings, a well 20 is provided with a string of casing 21 including a plurality of spaced landing nipples 22A, 22B and 22C. The landing nipples are included as integral sections of the casing string which is set in the well bore by suitable conventional procedures. For example, the casing string will normally be run into the well bore extending from the surface to a depth near the bottom of the well. Ordinarily the string is cemented by standard procedures which include pumping cement downwardly through the casing and back upwardly around the casing between the outer wall of the casing and the face of the formation penetrated by the well bore. After the proper setting of the casing in the well bore, a standard perforator is used to provide a first set of perforations 23 through the well casing below the lower landing nipple 22A into the bottom zone 1 of the earth formation around the casing. The zone 1 is then fractured or acidized or otherwise treated by standard procedures involving the pumping of a treating fluid downwardly in the casing or, alternatively, in a tubing string through a packer set in the casing above the perforations. The fluid is forced outwardly into the formation zone 1 through the perforations until the desired treatment is obtained. The equipment used in the first stage treatment is then removed from the well.

Figure 4:
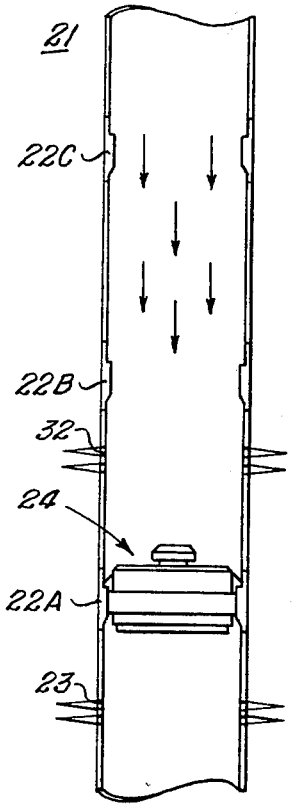
FIG. 4 is a schematic fragmentary view of the well bore illustrating a step of treating the formation around the well through the second set of perforations above the plug.

After completion of the first stage of the procedure as illustrated in FIG. 1, a retrievable well plug 24 is lowered into the well on a running tool 25 supported from a line 30. The plug is set at the landing nipple 22A above the perforations 23 to isolate the perforations from the well bore above the plug so that treating may be carried out above the plug without affecting the zone 1. Following the setting of the well plug, the running tool 25 is removed and a perforator 31 is lowered into the well to perforate the well casing at 32 above the well plug so that the zone 2 may be treated. The zone 2 is then treated as represented in FIG. 4 by pumping the treating fluid downwardly in the well casing and outwardly into zone 2 through the second set of perforations 32.

Figure 5:
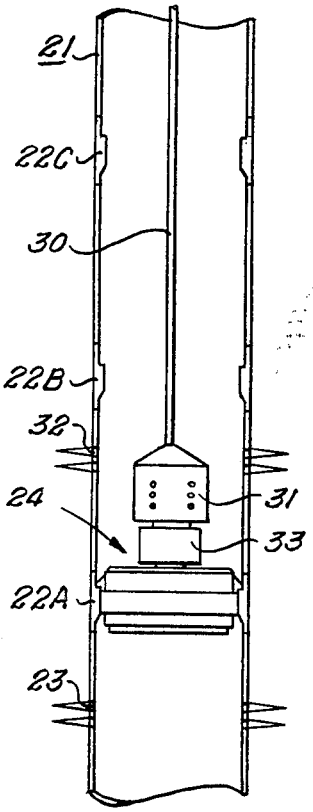
FIG. 5 is a schematic fragmentary view of the well illustrating a step of grasping the retrievable well plug with a combination overshot and perforating tool.

The perforator 31 is then connected with an overshot handling tool 33 for running into the well to manipulate the plug 24 and to again perforate the well casing. The overshot is coupled with the retrievable plug 24 as represented in FIG. 5. The well plug is then lifted from the first lower landing nipple 22A and reset at the second landing nipple 11B. The overshot and perforator are then released from the plug and lifted above the plug in the well casing to a position between the landing nipples 22B and 22C above the plug where the casing is again perforated a third time at 34 for treatment of the zone 3. The overshot and perforator are removed from the well casing and well treating fluid is forced into the zone 3 through the perforations 34. After completion of the treatment of the zone 3 through the perforations 34, the combined perforator and overshot tools are again used to move the retrievable plug 24 to the handling nipple 22C so that the well casing may be perforated above the plug again and the zone 4 around the well bore treated. The incremental treatment of the formation zones along the well bore is continued by the progressive resetting of the plug 24 with the combined handling tool 33 and perforator 31, the perforation of the well casing after each setting of the plug, and the removal of the running tool and perforator followed by the well treatment step. Such combination of steps is carried out until each of the desired zones has been so treated.

After the final step of treating the well, the plug is removed from the well bore and well completion procedures are used to prepare the well for production through the perforations in the casing. These steps are beyond the scope of the present invention.

Figure 7:
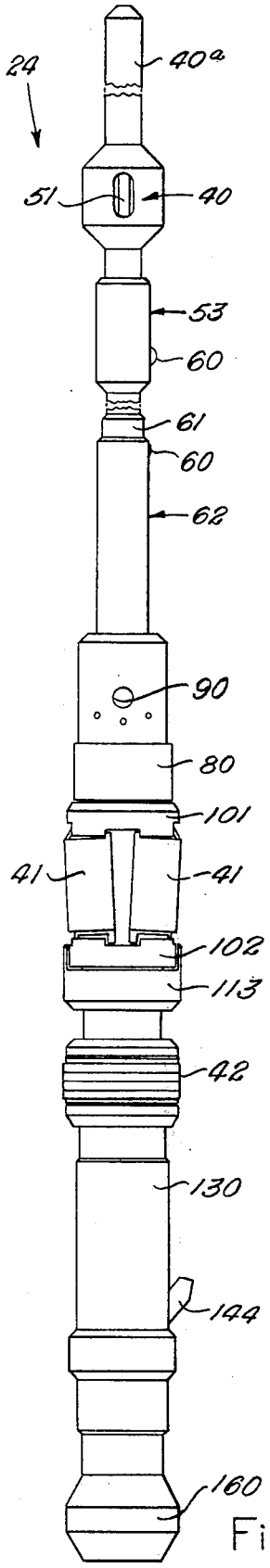
FIG. 7 is a view in elevation of the retrievable well plug used in carrying out the method of the invention.

The well plug 24 is a particularly preferred form of tool for temporarily closing the well casing bore below the location of each of the perforations through which a well treating step is carried out. Referring to FIG. 7, the plug broadly includes a handling head 40, a pair of radially movable locating and locking keys 41, an annular seal assembly 42 and an operating finger 144. The plug 24 is run into the well casing to a depth below a coupling recess along the casing below the lowest landing nipple on which the plug is to be set. The plug is then lifted to engage the operating finger 144. In the coupling recess for activating the locating and locking keys 41 which then spring outwardly to drag along the casing wall. The plug is lifted upwardly above the desired landing nipple and then lowered until keys 41 locate and expand into the locking recess of the nipple. The seal 42 engages the bore wall seal surface of the nipple to shut off fluid flow downwardly past the nipple within the casing so that well treating procedures may be carried out in the well bore above the plug. Thereafter, the plug is raised and relocked at subsequent landing nipples up the bore hole simply by engaging the head 40, lifting the plug above the desired landing nipple, and lowering the plug into locking engagement with the landing nipple. The keys 41 lock the plug against downward movement at each landing nipple so that it will hold pressure from above the plug while leaving the plug free to be lifted upwardly so that it may be raised and relocated at subsequent nipples up the hole without rotation of any parts.

Referring to FIGS. 8, 8A, and 8B, the handling head 40 of the plug 24 comprises an upper reduced neck portion **40*a*, an enlarged central portion 40*b*, and a reduced lower externally threaded portion 40*c*. The enlarged central portion 40*b* has a pair of longitudinal, diametrically opposed channels 44 and a lateral slot 45 which extends through the head portion 40*b* perpendicular to the line of position of the opposed channels 44. As shown in FIG. 9, a lock pin hole 50 extends across the head portion 40*b* perpendicular to the slot 45 and opening at the opposite ends into the channels 44. A handling tool operating lug 51 is positioned through the slot 45 with opposite ends projecting outwardly from the surface of the head portion 40*b* for engagement by handling recesses of the overshot tool 33. The lug is locked in slot 45 by a pin 52 in the hole 50. FIG. 9 shows the lug 51 and the locking pin 52 in elevation and the head portion 40*b*** in section.

The lower end portion **40*c* of the head 40 of the plug 24 is threaded into the upper end of a valve sub 53. The valve sub is counterbored and internally threaded at 54 to receive the head portion 40*c*. The lower end of the head portion 40***c* has a downwardly opening lateral slot 55 which receives the inward end portion of the shank of a buttonhead cap screw 60 threaded through the sub 53 into the bore 54 of the sub. The screw 60 prevents disengagement of the head 40 from the sub 53.

The valve sub 53 is externally threaded along a lower end portion 61 secured into an upper internally threaded portion of a valve member 62. The valve member has a blind upwardly opening bore 63 which defines a flow passage through the member as discussed hereinafter. A socket-head type set screw 64 is threaded through the upper end of the valve member against the outer surface of the sub 53 to lock the members together. An upper side port 65 opens into the bore 63 valve member below the threaded upper end portion for fluid communication with the bore. As shown in FIG. 8A, the valve member 62 has a lower side port 70 which opens into the lower end of the blind bore 63. The bore 63 with the upper and lower side ports 65 and 70 permit fluid bypass when the tool is being raised or lowered in a liquid filled borehole. The valve member 62 has a solid lower end valve head 71 which shuts off flow through the plug when the valve member is at a lower end seated position as represented in FIG. 15. The head 71 of the valve has a downwardly and inwardly tapered valve surface 72. The valve member 62 is provided with an external annular locking recess 73 used to lock the valve member at an upper open position when running the plug into a well. Additionally, the valve member has an external annular enlarged flange portion 74 providing a tapered upwardly facing locking shoulder 75 located below the locking recess 73. The locking shoulder 75 serves a retaining and lifting function as discussed hereinafter.

The valve member 62 is telescoped into a body mandrel formed of a top sub 80, a key mandrel 81, and a main mandrel 82. The mandrel 80 fits loosely around the valve member 62 and is provided with a reduced upper end portion defining an internal annular tapered shoulder 83 which is engageable with the shoulder 75 on the valve member 62 for holding the mandrel and valve member together and to permit the plug to be supported in a borehole by the valve member when a running tool is engaged with the head 40. The upward reduced end portion of the top sub 80 has a graduated side bore 84 having an enlarged inward end portion and a reduced outer portion to receive a locking lug 85 which has a tapered inward end engageable in the locking recess 73 of the valve member 62 for locking the valve member at the position shown in FIG. 8A in the plug mandrel. The lug 85 has a head portion 85*a* which is disposed in the enlarged inward end portion of the side bore 84 and has a reduced stem portion 85*b* which may extend through the reduced outer end portion of the side bore 84. The top sub 80 has a plurality of side ports 90 for fluid communication through the sub at various stages in the operation of the plug. FIG. 8A shows the plug connected with a tube 91 of a handling tool used to activate the locking keys and make the initial installation of the plug in a well bore. The tube 91 is coupled with the sub 80 by a plurality of shear pins 92 which extend through the holes 93 in the tube into corresponding aligned holes 94 in the sub. When the handling tube 91 is connected with the mandrel sub 80 of the plug as shown, the inner wall face of the handling tube holds the lug 85 at the inward locking position illustrated, at which it extends into the locking recess 73 on the plug valve member 62 to hold the valve member open so that fluid may bypass through the plug as it is lowered and raised in the well bore during the initial setting steps. An external annular flange 95 on the mandrel sub 80 limits downward movement of the handling tube 91 on the mandrel.

The mandrel sub 80 is threaded onto the upper end portion of the key mandrel 81 until the upper end edge of key mandrel engages an internal annular downwardly facing shoulder 100 provided within the sub 80 at the upper end of the downwardly extending internally threaded lower end of the sub. The locating and locking keys 41 are supported on the key mandrel 81 between an upper key retainer 101 and a lower key retainer 102 and biased outwardly to expanded locking positions by springs 46. Each of the keys 41 has upwardly and outwardly opening slots 103 engaged by correspondingly positioned downwardly extending retainer flanges 104 formed on and circumferentially spaced around the upper key retainer 101. Similarly, the lower key retainer 102 is provided with upwardly extending retainer flanges 105 which engage downwardly and outwardly opening slots 110 formed in the keys 41. Each of the keys has a pair of the upwardly and downwardly opening retainer slots and the radial depths of the retainer flanges and slots on the keys are proportioned to permit the keys to expand and contract radially sufficiently to properly lock the plug at the desired landing nipples along the well casing. The key mandrel 81 is threaded onto an upper end portion of the main body mandrel 82. The lower end edge 112 of the key mandrel serves as a stop for an internal annular flange 102*a* of the lower key retainer disposed around the main body mandrel. Slidably supported on the main body mandrel 82 below the key retainer 102 is a key keeper sleeve 113 which has upwardly extending finger portions 113*a* telescoping upwardly over the lower ends of the fingers 41 between the flange portions 105 of the lower key retainer so that the key keeper retains the lower ends of the keys 41 radially contracted when the keeper is at the upper end position of FIG. 8A and releases the lower ends of the keys for outward expansion when shifted downwardly on the body mandrel to the position illustrated in FIG. 14. The key keeper 113 fits loosely on the body mandrel 82 and is coupled by a cross pin 114 with a tubular cross pin carrier 115 disposed within the bore of the body mandrel 82. The cross pin extends through a hole 120 in the body portion of the key keeper 113, through a longitudinal slot 121 in the body mandrel 82, and is threaded along a reduced shank portion 144*b* into the cross pin carrier. The head 114*a* of the cross pin forms a loose fit in the hole 120 of the key keeper and in the slot 121 of the body mandrel. The key keeper is thus coupled longitudinally with the cross pin carrier so that the key keeper, cross pin, and carrier may move longitudinally on the body mandrel between a key retaining position as in FIG. 8A and a key release position as in FIG. 13.

Referring to FIG. 8B, the annular seal assembly 42 is secured on the body mandrel 82 below the slot 121 for sealing around the body mandrel with the bore wall surface in each of the landing nipples in which the plug is releasably locked for carrying out the well treating procedures. The seal assembly includes V-type packing 122 retained by a ring 123 on an annular body 124 which is threaded onto the body mandrel 82. An O-ring seal 125 in an internal annular recess of the body 124 seals between the body and the mandrel 82. The body mandrel 82 is reduced to a uniform diameter along a lower end portion 82*a* below an external downwardly facing annular stop shoulder 82*b*. A sleeve 130 is secured on the reduced body mandrel portion 82*a* below the shoulder 82*b* by two shear pins 131. A lower cross pin 132 is secured along a threaded shank portion 132*a* into a lower end portion of the cross pin carrier 115. The head 132*b* of the lower cross pin fits loosely through a longitudinal slot 133 in the body mandrel 82 into a round hole 134 in the sleeve 130. The shear pins 131 temporarily connect the sleeve 130 with the body mandrel while the cross pin 132 couples the sleeve 130 with the cross pin carrier 115 permitting relative longitudinal movement between the body mandrel 82 and the cross pin carrier and sleeve 130. A ring seal 116 in an external annular recess around the cross pin carrier seals between the carrier and the body mandrel section 82. Below the slot 133 the body mandrel 82 is reduced in internal diameter providing a reduced bore 135 and defining an upwardly facing internal annular stop shoulder 140 which is engageable by the lower end edge of the cross pin carrier limiting the extent to which the body mandrel 82 telescopes upwardly on the cross pin carrier in the step of releasing the locating and locking keys 41.

The sleeve 130 is provided with a longitudinal slot 141 which generally registers with a longitudinal slot 142 in the body mandrel 82 when the sleeve and body mandrel are in the relative positions shown in FIG. 8B for running the well plug into the well bore. The lower end of the body mandrel slot 152 is defined by an upwardly and outwardly sloping cam surface 143. An operating finger 144 is pivoted on a shaft 145 supported at opposite ends in corresponding lateral bores 150 in opposite side wall portions of the sleeve 130. The pivoted inward end of the operator finger 144 is disposed within the bore 135 of the lower portion of the body mandrel 82 with the shaft 145 extending through opposite corresponding longitudinal slots 151 in the body mandrel which allow the body mandrel to move within the sleeve 130 relative to the operator finger. A spring 152 secured within the bore 135 by a screw 153 bears against the inside edge 144*a* of the operator finger biasing the finger outwardly on the shaft 145 through the aligned longitudinal slots 141 and 142. The cam surface 143 of the body mandrel slot 142 is engageable with the lower edge 144*b* of the operator finger for pivoting the operator finger upwardly and inwardly responsive to upward movement of the body mandrel relative to the sleeve 130. A spring-biased plunger assembly 153 having an extendable locking head 154, FIG. 13, is secured through the side wall of the body mandrel 82 below the slot 142. The locking plunger head 154 is extendable into a longitudinal slot 155 in the sleeve 130 when the plunger assembly is aligned with the slot to limit further relative longitudinal movement between the sleeve 130 and the body mandrel 82. A guide shoe 160 having a tapered lower end surface 160*a* is threaded on the lower end portion of the body mandrel 82 to facilitate movement of the plug downwardly in a well casing. The surface 160*a* mimimizes the possibilities of the plug lodging in the well bore at a landing nipple or coupling recess along the casing.

As previously discussed, the plug 24 is initially run into the well 20 and set in the bottom landing nipple 22A after the perforations 23 have been made through the casing into the zone 1 and the zone has been treated. The plug is connected with the handling sleeve 91 by shear pins 92 which couple the sleeve with the upper end of the body mandrel sub 80 as shown in FIG. 8A. The sleeve 91 may comprise the lower end of a string of tubing used for installing the plug or may comprise a handling tool connected with suitable jars supported by a wireline in the tubing string. Such equipment is well known and standard in the industry for installation and removal of well tools which require the application of upward or downward forces to the tools for operation. The well plug is introduced into the well bore in the condition represented in FIGS. 8A and 8B at which the locating and locking fingers 41 are held inwardly by the sleeve 113. The body mandrel of the tool is in a downward position relative to the sleeve 130 as represented in FIG. 8B. As the plug lowered in the well casing, the operating finger 144 drags along the bore wall surface of the casing as shown in FIG. 10. The casing wall pivots the finger upwardly and inwardly away from the lower end surfaces of the longitudinal slots 141 and 142 in the sleeve 130 and the body mandrel 82.

The plug 24 is lowered until it is known to be below a coupling recess along the well casing below the bottom landing nipple 22A. Such a recess is represented in FIG. 11 which shows the lower end of one of the casing sections P-1 and the upper end of another casing section P-2, making up the casing string below the bottom landing nipple. The casing sections are connected together by a coupling C. The coupling recess 21*b* is defined between the lower end edge of the casing section P-1 and the upper end edge of the casing section P-2 within the coupling. Suitable standard techniques are used to measure the depth of the plug as it is lowered in the well bore so that a location below the desired coupling recess is readily determined. Once the plug is below the desired recess, it is lifted upwardly in the casing. When the free end of the operating finger 144 reaches the coupling recess, the spring 152 pivots the finger farther outwardly so that the finger end enters the coupling recess lodging against the lower end edge 21*c* of the upper casing section P-1 defining the upper end of the recess. The engagement of the operating finger in the coupling recess holds the finger against upward movement. The finger is pivoted outwardly and downwardly on the shaft 145 which is connected with the sleeve 130 so that when the finger is held against upward movement, the sleeve 130 cannot move upwardly. Upward force is applied to the plug from the handling sleeve 91 through the shear pins 92 which lifts the body mandrel comprising the sections 80, 81, and 82. Since the shaft 150 passes through the slots 151 of the lower end portion of the body mandrel section 82, the upward force is transmitted to the finger 144 through the shear pins 131 from the body mandrel section 82 to the sleeve 130 in which the ends of the finger shaft 150 are journaled. Due to the slots 151 in the body mandrel, the body mandrel tends to move upwardly relative to the operating finger resisted only by the shear pins 131. When the shear strength of the pins 131 is exceeded, the pins shear releasing the body mandrel to move upwardly relative to the operating finger 144 and the sleeve 130. As the body mandrel is lifted, the sleeve 130 is held against upward movement by the engagement of the operating finger in the coupling recess so that the lower cross pin 132 holds the cross pin carrier 115 against upward movement. The upper cross pin 144 is connected between the upper end of the cross pin carrier and the key keeper sleeve 113. The body mandrel slots 121 and 133 allow the body mandrel to move upwardly relative to the cross pins so that the shearing of the pins 131 releases the body mandrel for upward movement while the only parts held downwardly are the operating finger 144, the sleeve 130, the cross pin carrier 115 and the key keeper sleeve 113. The keys 41 are lifted with the body mandrel so that the lower ends of the keys are pulled from behind the key retainer portions 113*a* releasing the keys to expand outwardly against the casing wall as shown in FIG. 13. As the plug body mandrel moves upwardly relative to the finger 144 and sleeve 130, the cam surface 143 defining the lower end of the mandrel slot 142 engages the bottom edge 144*b* of the operator finger camming the finger inwardly to the position shown in FIG. 13 so that the end of the finger no longer extends outwardly far enough to engage any recesses or other obstructions along the casing wall as the plug is lifted. The relative dimensions of the parts effects essentially simultaneous release of the locating and licking keys 41 with the retraction of the operator finger 144 to an inoperative position. At the same time that the body mandrel 82 is raised relative to the sleeve 130, the plunger assembly 153 is aligned with the slot 155 in the sleeve 130 so that the locking head 154 of the spring assembly expands into the slot to prevent the return of the sleeve 130 and the mandrel 82 to the relative positions of FIG. 8B. Thus, the plug is activated by release of the locating and locking keys 41, the plunger assembly head 154 prevents a relocking of the keys inwardly on the body mandrel and further prevents the re-extension or pivoting of the operator finger 144 back to a position that would engage another coupling recess along the casing.

During the steps of lowering the plug below the coupling recess 21*b*, raising the plug to the recess, and activating the plug keys 41 as described, together with the further lifting of the plug along the well casing above the coupling recess toward the bottom landing nipple, the plug is supported as shown in FIG. 8A by the handling tool sleeve 91. The inner wall surface of the sleeve 91 holds the lug 85 inwardly engaging the recess 73 on the valve member 62. The valve member is thus held upwardly at the open position illustrated in FIG. 8A so that the well fluids may flow freely through the plug and handling tool as the plug is both lowered and thereafter raised in a well bore. The well fluids enter the open end of the guide shoe 160 flowing along the bore of the lower portion of the body mandrel 82, through the bore of the cross pin carrier 115, and continue upwardly around the lower solid end portion 71 of the valve member. The fluids flow inwardly through the lower ports 70 into the bore 63 of the valve member, upwardly through the bore, and outwardly back into the well casing through the upper ports 69. Fluids may thus bypass the plug during both the lowering and the raising of the plug in a well.

The plug is lifted along the well casing into the bottom landing nipple 22A. The keys 41 drag along the casing wall surface, biased constantly outwardly by the springs 46. When the keys are aligned with the internal locking recess 170 of the landing nipple, the keys expand into the recess. As a practical matter, the plug will probably have to be lifted slightly above the landing nipple and then lowered back to the nipple, at which time the keys will expand into the recess 170 holding the plug against downward movement. It may be difficult during the upward trip of the plug through the landing nipple to detect exactly when the keys have been expanded into the locking recess. In contrast with the plug lifted above and then lowered into the nipple, the keys will prevent the plug from moving downwardly through the nipple. The bottom locking shoulders 41*a* on each of the keys engages the locking shoulder 171 defining the lower end of the locking recess 170 in the landing nipple. Since these are abrupt shoulders, the keys cannot move downwardly past the locking relationship shown in FIG. 14 in the landing nipple recess.

With the keys expanded in locking relationship in the landing nipple, the handling sleeve 91 is jarred downwardly shearing the pins 92 to release the sleeve from the sub 80 of the body mandrel. The running tool is then lifted disengaging the sleeve from the plug. When the sleeve 91 is lifted from the sub 80, the lug 85 is free to move outwardly. The weight of the plug structure resting on and including the valve member 62 cams the lug 85 outwardly releasing the valve member 62 to drop downwardly farther into the bore of the plug body mandrel to the closed position shown in FIG. 15. The valve surface 72 on the lower end of the valve member engages the valve seat surface 115*a* around the upper end of the bore of the cross pin carrier shutting off the bore through the plug. The seal assembly 42 engages a seal surface around the bore of the landing nipple 22A, the O-ring 114 seals within the plug mandrel 82 around the cross pin carrier, and the valve surface 72 on the valve member 62 closes off the bore through the cross pin carrier so that the casing is completely closed by the plug to allow well treating processes to be carried out in the well casing above the plug, as previously discussed, without affecting the well below the plug.

Figure 6:
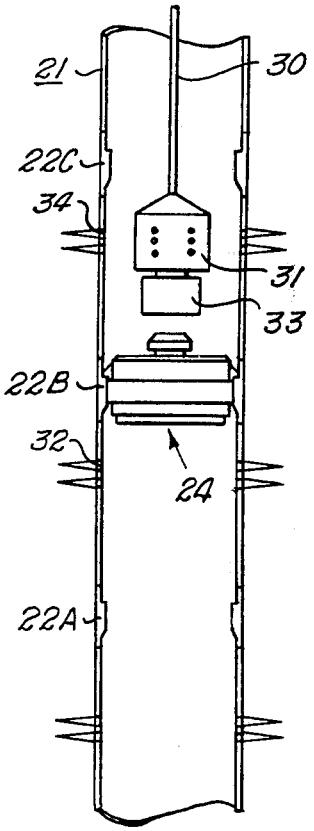
FIG. 6 is a fragmentary schematic view of the well showing the lifting of the plug to the second landing nipple up the casing and the perforating and overshot handling tool released from the well plug and perforating the casing at a third location up the well.

Upon completion of treating the well formation zone 2 through the perforations 32 above the plug, the plug is moved upwardly to the next landing nipple 22B. In order to minimize the round trips into the well, a Halliburton No. 69520678 overshot is coupled with a suitable perforator which are lowered as a unit into the well bore. The overshot has an internal J-slot arrangement which permits engagement with the exposed end portions of the lug 51 in the head of the plug 24. The particular shape of the J-slot in the overshot allows the overshot to set down on the plug head in such a manner that it engages with the plug head lug when lifted. The particular type of J-slot in the overshot, sometimes referred to as a "crazy J-slot," allows the overshot to be connected and disconnected by up and down movements only, without rotation. When the overshot is to be uncoupled from the plug, it is lowered with the J-slot causing the overshot to be indexed around sufficiently to align the lug heads 51 with exit portions of the J-shot so that the overshot is lifted easily from the plug head. Thus, when the overshot and perforator are first lowered through the well bore onto the head of the plug and the overshot is then lifted, it engages and lifts the head 40 of the plug raising the valve member 62 until the shoulder 75 of the valve member engages the internal shoulder 83 within the plug mandrel 80 as shown in FIG. 14. With the lifting force then being applied through the valve member 62 to the mandrel sub of the plug, the keys 41 on the plug are cammed inwardly out of the locking recess 170 of the landing nipple 22A releasing the plug from the landing nipple. The plug is then lifted upwardly through the next landing nipple 22B and lowered downwardly back into the nipple until the keys 41 expand into and lock at the locking recess of such nipple. During the lifting of the plug between the nipples, the force of gravity holds the body mandrel and related parts at the lower position represented in FIG. 14 so that the valve member 62 is held open allowing liquid in the well bore to bypass the plug as the plug is raised. The overshot and perforator are again lowered so that the valve member drops to the closed position of FIG. 15 and the overshot is indexed around to a position at which it freely releases from the plug head when lifted so that the perforator and overshot may be raised to the location shown in FIG. 6 to perforate the casing at 34 into formation zone 3 and thereafter be removed from the wel bore to treat the well through the perforations. At all times after the initial activation of the plug, including the release of the keys 41, the plunger assembly head 154 remains engaged in the slot 155 at the lower end of the plug mandrel 82 to retain the plug parts in the proper longitudinal relationship for holding the operator finger 144 inwardly at an inoperative position and to keep the locating and locking keys 41 released to drag along the casing bore wall and lock at the recess in each of the landing nipples. The plug is activated by dragging upwardly through a coupling recess; the plug is thereafter reset in succeeding landing nipples up the well bore casing by the steps of lifting the plug through each nipple above the locking recess of the nipple and then lowering the plug back into the nipple until the locking keys engage and support it against further downward movement. When the last of the treating steps is carried out in the well, the plug is retrieved to the surface in the same manner as it is lifted between landing nipples.

It will now be seen that a new and improved well treating procedure has been described and illustrated for sequentially treating increments of a thick formation which cannot be satisfactorily treated in a single step. It will be understood that the procedure includes steps of setting and resetting a retrievable well plug which is movable between landing nipples along a well casing by the application of only upwardly and downwardly applied forces, thereby not requiring rotation of any parts of the plug to release and reset it. It will be further seen that the well plug includes an operating finger for initially activating the plug at a coupling recess along the casing bore of the well, expandable and contractable locating and locking keys, a seal assembly for engagement with a seal surface of a landing nipple, and a handling head connected with a longitudinally movable valve which is opened when the plug is lifted by the head and closed when the plug is set in a landing nipple.

What is claimed is:

1. A method of treating an earth formation through a well bore comprising: setting a wireline operated retrievable plug in a landing nipple in said well bore for temporarily blocking said well bore against downward flow at a first depth; perforating the wall of said well bore above said plug; introducing treating fluid into said well bore and displacing said fluid into said earth formation above the location at which said well bore is temporarily blocked; releasing, lifting, and resetting said plug by wireline means at another landing nipple without removal from said well bore for temporarily blocking said well bore at a second lesser depth above the location of the first treating step; again perforating the wall of said well bore above said plug; displacing treating fluid into said formation from said well bore above said second location of blocking said well bore; and thereafter sequentially engaging, releasing, lifting and resetting said plug by wireline means at subsequent landing nipples up said well bore for temporarily blocking said well bore at spaced locations up said bore, perforating the wall of said well bore above said plug, and displacing treating fluid into said formation from said well bore above each location of blocking said well bore until the desired depth of said formation has been incrementally treated; and said retrievable plug being moved is said well bore by means of a combined handling tool and perforator which first engages, lifts and resets said plug and thereafter is disengaged from said plug lifted and effects perforations through the wall of said well bore.

2. A method of incrementally treating an earth formation penetrated by a well bore lined with a string of casing including a plurality of landing nipples spaced in said casing along the portion of said earth formation to be treated comprising the steps of: perforating said casing below a first lower one of said landing nipples, displacing treating fluid into said earth formation through said first perforations; setting a retrievable well plug by wireline means in said well bore at said first lower landing nipple to shut off said well bore above said first perforations; said well plug being inserted into said well on a running tool, activated at a coupling recess in said well casing to expand locating keys on said plug below said first lower landing nipple, lifted into engagement with said landing nipple, and said running tool being disengaged from said plug and removed from said well bore; forming a second set of perforations in said casing above said well plug; displacing treating fluid into said well formation through said second perforations; moving said well plug from said first landing nipple to a second landing nipple up said well bore by wireline means without removal from said well bore; perforating said well casing at a third location above said second landing nipple; displacing treating fluid into said well formation through said third perforations; and thereafter sequentially moving said well plug to succeeding landing nipples up said well bore by wireline means without removal from said well bore, and perforating said casing and treating said well formation through such perforations above each of said succeeding landing nipples at which said well plug is set; said plug being retrieved from each landing nipple and reset in a succeeding landing nipple up said well bore by means of an overshot coupled with a perforator, said overshot being adapted to reset said plug in each of said succeeding landing nipples by upward and downward movements only for coupling with an uncoupling from said plug in lifting said plug into and engaging said plug with each said landing nipple.

3. A method of segmentally treating an earth formation penetrated by a well bore comprising: releasably securing by wireline means temporary plug means at a landing nipple in said well bore below a first selected segment of said earth formation; perforating the well bore wall along said selected segment to provide fluid access to said selected segment of said formation; introducing treating fluid into said well bore and displacing said fluid through perforations into said first selected segment of said formation; releasing, moving, and reengaging said temporary plug means at a landing nipple in said well bore below any additional selected segment of said formation to be treated, said plug means being moved within said well bore by wireline means without removing said plug means from said well bore; and repeating said perforation and treating steps at each additional segment; said plug means being is moved between said selected segments by means of a combined handling tool and perforator which first engages, lifts, and resets said plug means and thereafter is disengaged from said plug means lifted, and effects perforations through said well bore.

4. A method of segmentally treating an earth formation penetrated by a well bore lined with a string of casing including a plurality of landing nipples spaced in said casing along the portion of said earth formation to be treated comprising the steps of: wireline setting a retrievable well plug in said well bore at a lower one of said landing nipples below the lowest selected segment of said earth formation to be treated to shut off said well bore below said landing nipple; said well plug being inserted into said well bore on a running tool, activated at a coupling recess in said well casing to expand locating and locking keys on said well plug below said first selected landing nipple, lifted into engagement with said landing nipple, and said running tool being disengaged from said plug; forming a set of perforations in said casing above said well plug; displacing treating fluid into said well formation through said perforations; moving said well plug from said first used landing nipple to succeeding landing nipples below each succeeding selected segment of said formation up said well bore from said first selected segment to be treated; and repeating said steps of perforating said well casing above said plug at each said succeeding landing nipple and displacing said treating fluid into said well formation through such perforations, said steps of relocating said well plug and perforating and treating being repeated without removal of said plug from said well bore until all desired selected segments of said well formation have been treated; said plug being retrieved from each selected landing nipple and reset in a succeeding landing nipple of said well bore by means of an overshot coupled with a perforator, said overshot being adapted to reset said plug in each of said succeeding landing nipples by upward and downward movements only for coupling with and uncoupling from said plug and lifting said plug into and engaging said plug with each said landing nipple; and removing said well plug from said well bore subsequent to treating the last of said selected segments of said well formation.

5. A method of incrementally treating an earth formation penetrated by a well bore lined with a string of casing including a plurality of landing nipples spaced in said casing along the portion of said earth formation to be treated comprising the steps of: perforating said casing below a first lower one of said landing nipples, displacing treating fluid into said earth formation through said first perforations; setting a retrievable well plug by wireline means in said well bore at said first lower landing nipple to shut off said well bore above said first perforations; said well plug inserted in the said well bore on a wireline supported running tool, activated at a coupling recess in said well casing to expand locating and locking keys on said plug at a position within said well bore below said first lower landing nipple, lifted into said first lower landing nipple above a locking recess therein, lowered in said landing nipple until said locating and locking keys expand into said locking recess in said landing nipple, and said running tool being disengaged from said plug; forming a second set of perforations in said casing above said well plug; displacing treating fluid into said well formation through said second perforations; moving said well plug from said landing nipple to a second landing nipple up said well bore by wireline means without removal from said well bore; perforating said well casing at a third location above said second landing nipple; displacing treating fluid into said well formation through said third perforations; and thereafter sequentially moving said well plug to succeeding landing nipples up said well bore by wireline means without removal from said well bore, and perforating said casing and treating said well formation through such perforations above each of said succeeding landing nipples at which said well plug is set; said plug being retrieved from each landing nipple and reset in a succeeding landing nipple up said well bore by upward and downward movements only for engaging said locating and locking keys with locking recess in each of said landing nipples and for coupling with and uncoupling from said plug, said plug being relocated in each of said landing nipples from said first lower landing nipple through the last of said succeeding landing nipples without removal of said plug from said well bore.

6. A method of segmentally treating an earth formation penetrated by a well bore lined with a string of casing including a plurality of landing nipples spaced in said casing along the portion of said earth formation to be treated comprising the steps of: wireline setting a retrievable well plug in said well bore at a lower one of said landing nipples below the lowest selected segment of said earth formation to be treated to shut off said well bore below said landing nipple; said well plug being inserted into said well bore on a wireline supported running tool, activated at a coupling recess in said well casing to expand locating and locking keys on said well plug at a position of said plug below said first selected landing nipple, lifted into engagement with said landing nipple above the locking recess therein, lowered in said landing nipple until said locating and locking keys expand into said locking recess, and disengaged from said plug leaving said plug in said landing nipple for treating said earth formation from said well bore above said landing nipple; forming a set of perforations in said casing above said well plug; displacing treating fluid into said well formation through said perforations; moving said well plug from said first used landing nipple to succeeding landing nipples below each succeeding selected segment of said formation up said well bore from said first selected segment to be treated; and repeating said steps of perforating said well casing above said plug at each said succeeding landing nipple and displacing said treating fluid into said well formation through such perforations, said steps of relocating said well plug and perforating and treating being repeated without removal of said plug from said well bore until all desired selected segments of said well formations have been treated; said plug being retrieved from each selected landing nipple and reset in a succeeding landing nipple of said well bore by means of an overshot supported from a wireline, said overshot being adapted to engage and reset said plug in each of said succeeding landing nipples by upward and downward movements only for coupling with and uncoupling said plug and lifting said plug into and engaging said plug with each of said landing nipples by lowering said plug from above a locking recess in each of said landing nipples until said locating and locking keys on said plug expand into said locking recess, the relocation of said plug to each of said succeeding landing nipples being effected without removal of said plug from said well bore; and removing said well plug from said well bore subsequent to treating the last of said selected segments of said well formation.

* * * * *

UNITED STATES PATENT OFFICE

CERTIFICATE OF CORRECTION

Patent No. 3,957,115 Dated May 18, 1976

Inventor(s) Richard Kerzee, Robert W. McCollum, Carter R. Young

It is certified that error appears in the above-identified patent and that said Letters Patent are hereby corrected as shown below:

Column 2, line 31, after the word "step" cancel "in" and insert -- of --.
Column 3, line 58, "11B" should read "22B".
line 68 - Column 4, line 1, "handling" should read "landing".

line 31, insert -- the -- after "until".
line 62, insert -- the -- after "locked in".
Column 5, line 15, insert -- of the -- after "63".
Column 9, lines 20 - 21, "licking" should read "locking".
line 48, insert -- lower -- after "open".
Column 10, line 59, insert -- sub -- after "mandrel".
Column 11, line 12, "wel" should read "well".
Column 12, line 9, Claim 1, "is" should read "in".
line 26, insert -- and locking -- after "locating".

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*